United States Patent [19]

Sing

[11] Patent Number: 4,674,200

[45] Date of Patent: Jun. 23, 1987

[54] SLIP RESISTANT FOOTWEAR

[76] Inventor: Peter Sing, 168-10 84th Ave., Jamaica Hill, N.Y. 11432

[21] Appl. No.: 808,621

[22] Filed: Dec. 12, 1985

[51] Int. Cl.[4] ..... A43B 13/22; A43B 13/20; A43B 3/10; A43C 15/00

[52] U.S. Cl. ..... 36/7.6; 36/29; 36/59 R

[58] Field of Search ..... 36/7.6, 7.7, 29, 59 R, 36/59 A, 59 C, 3 B

[56] References Cited

U.S. PATENT DOCUMENTS

| | | | |
|---|---|---|---|
| 1,133,135 | 3/1915 | Hall | 36/59 A |
| 1,148,376 | 7/1915 | Gay | 36/29 |
| 1,653,059 | 12/1927 | Nelson | 36/29 |
| 2,738,598 | 3/1956 | Inga | 36/59 R |
| 3,043,025 | 7/1962 | Semon | 36/59 C |
| 3,225,463 | 12/1865 | Burnham | 36/29 X |
| 4,063,371 | 12/1977 | Batra | 36/3 B |
| 4,118,878 | 10/1978 | Semon | 36/59 C |

FOREIGN PATENT DOCUMENTS

| | | | |
|---|---|---|---|
| 1598123 | 8/1970 | France | 36/3 B |
| WO8200571 | 3/1982 | World Int. Prop. O. | 36/29 |

*Primary Examiner*—James Kee Chi
*Attorney, Agent, or Firm*—David Aker

[57] ABSTRACT

Slip resistant footwear comprising a sole having a top face and a bottom face for contact with the surface to be walked upon; a vacuum chamber whose volume decreases when force is applied to the top face of the sole; a passageway connecting the bottom face of the sole with the vacuum chamber; means for permitting the passage of air from the vacuum chamber to the atmosphere operative when the volume of the vacuum chamber decreases; and means for securing the sole proximate to a foot of the user.

22 Claims, 17 Drawing Figures

D—D'

C — C'

SLIP RESISTANT FOOTWEAR

BACKGROUND OF THE INVENTION

This invention relates to footwear, and more particularly to footwear that facilitates perambulation of slippery surfaces.

SUMMARY OF THE INVENTION

The present invention, slip resistant footwear, comprises a sole having a top face and a bottom face for contact with a surface to be walked upon, a vacuum chamber whose volume decreases when force is applied to the top face of the sole, a passageway connecting the bottom face of the sole with the vacuum chamber, means for permitting the passage of air from the vacuum chamber to the atmosphere operative when the volume of the vacuum chamber decreases, and means for securing the sole proximate to a foot of the user.

This invention is especially useful for walking on slippery surfaces, such as those that are covered with ice or a layer of oil. The motion of the user creates a suction force at the bottom face of the sole, which lessens the potential for slippage and harmful injury.

Specific embodiments of the present invention are described in detail below.

DESCRIPTION OF THE PREFERRED EMBODIMENTS

Figure 1:
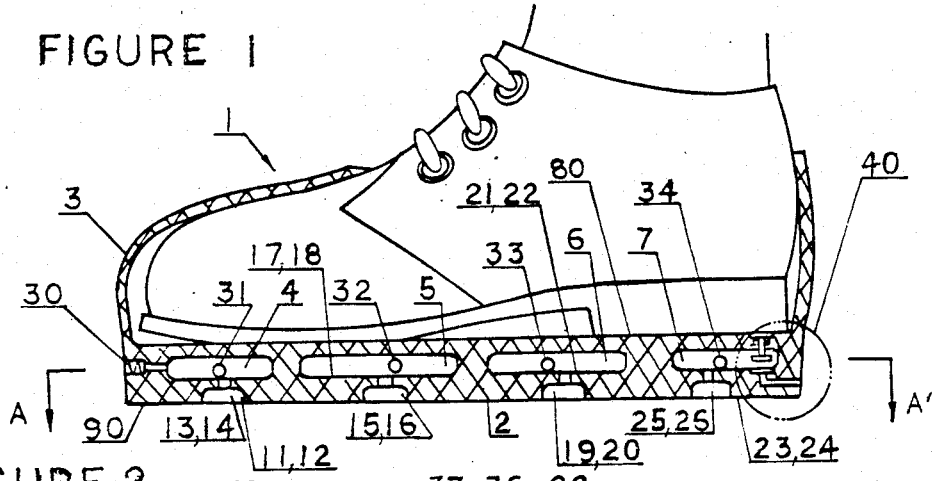
FIG. 1 shows a sectional side view of one type of footwear embodying the present invention.

FIG. 1 shows a type of footwear embodying the present invention that is worn over the normal footwear of the user, in the manner of galoshes or the like. Specifically, footwear 1 comprises sole 2, having top face 80 and bottom face 90, joined to upper 3. Sole 2 is made of a resilient material and is sufficiently thick to contain a plurality of vacuum chambers, denominated 4, 5, 6 and 7 in the Figures. Vacuum chambers 4–7, each of which has a floor proximate to bottom face 90 and a roof proximate top face 80, are additionally defined by transverse sole supports 62, 64 and 66, and by sole sidewall 68. Transverse sole supports 62, 64 and 66, and sidewall 68, serve to transfer the force exerted by the user on top face 80 of sole 2 to bottom face 90.

Figure 2:
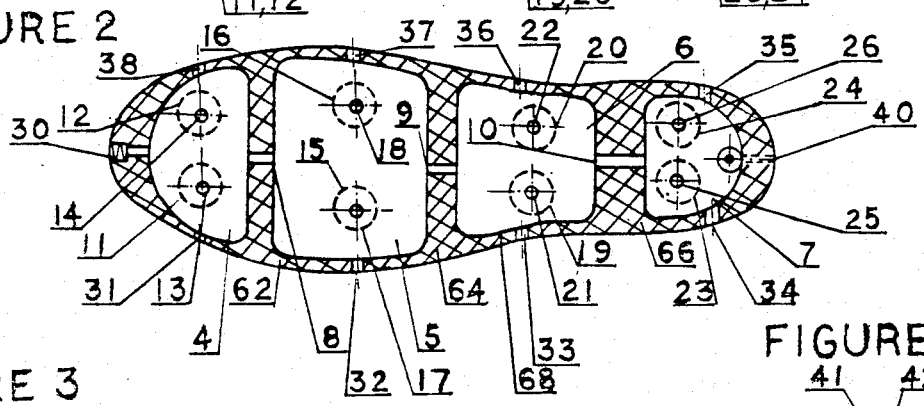
FIG. 2 shows a sectional view taken along section line A–A′ in FIG. 1.

As can be seen in FIG. 2, interchamber passage 8 pierces transverse sole support 62 to connect vacuum chambers 4 and 5 and allow air to pass between them. In like manner, interchamber passage 9 pierces transverse sole support 64 to connect vacuum chambers 5 and 6, and interchamber passage 10 pierces transverse sole support 66 to connect vacuum chambers 6 and 7. Interchamber passages 8–10 insure that the air pressure in vacuum chambers 4–7 is approximately equal.

FIGS. 1 and 2 further show vacuum cups located in the bottom portion of sole 2, which cups are connected to the vacuum chambers via vacuum cup passageways. Specifically, vacuum cups 11 and 12 are respectively connected to vacuum chamber 4 via vacuum cup passageways 13 and 14. Similarly, vacuum cups 15 and 16 respectively are connected to vacuum chamber 5 via vacuum cup passageways 17 and 18; vacuum cups 19 and 20 are respectively connected to vacuum chamber 6 via vacuum cup passageways 21 and 22; and vacuum cups 23 and 24 are respectively connected to vacuum chamber 7 via vacuum cup passageways 25 and 26.

Each vacuum chamber is additionally connected to the atmosphere through side 68 of sole 2 via a number of air exit passageways containing check valves. Specifically, check valves 30, 31 and 38, located in air exit passageways in side 68 of sole 2, connect vacuum chamber 4 with the atmosphere. Similarly, check valves 32 and 37, located in air exit passageways in side 68 of sole 2, connect vacuum chamber 5 with the atmosphere; check valves 33 and 36, located in air exit passageways in side 68 of sole 2, connect vacuum chamber 6 with the atmosphere; and check valves 34 and 35, located in air exit passageways in side 68 of sole 2, connect vacuum chamber 7 with the atmosphere.

Figure 3:
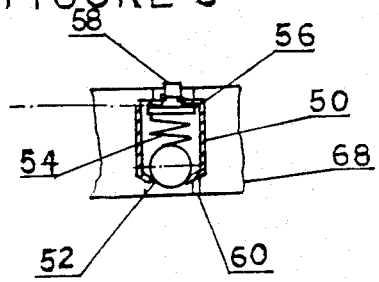
FIG. 3 shows a sectional view of a check valve usable in this invention.

Each of check valves 30–38 are oriented so as to allow passage of air from chambers 4–7 via the air exit passageways to the atmosphere, but to block passage of air from the atmosphere to chambers 4–7. More specifically, FIG. 3 shows one embodiment of each of check valves 30–38. There is shown valve housing 50, located in side wall 68 of sole 2, which contains ball 52, check spring 54, adjustable pressure plate 56 and pressure release level adjustment screw 58. Ball 52 is biased by spring 54 against valve seat 60. Valve seat 60 of each of check valves 30, 31 and 38 is proximate to vacuum chamber 4. Similarly, valve seat 60 of each of check valves 32 and 37 is proximate to vacuum chamber 5, valve seat 60 of each of check valves 33 and 36 is proximate to vacuum chamber 6, and valve seat 60 of each of check valves 34 and 35 is proximate to vacuum chamber 7. Pressure release level adjustment screw 58 in each of check valves 30–38 is accessible for adjustment by the user through sidewall 68.

When the air pressure in vacuum chambers 4–7 exceeds the pressure of spring 54 urging ball 52 against seat 60 of each of the check valves, ball 52 is forced off seat 60 and air passes between seat 60 and ball 52 of each of check valves 30–38 and escapes to the atmosphere. Atmospheric air cannot however enter vacuum chambers 4–8 through any of check valves 30–38, because any pressure differential tending toward such a result simply urges ball 52 of each check valve even more strongly against seat 60.

Other types of check valves, such as flap valves, butterfly valves or modified bicycle tire valves (e.g., a soft tube contained in a hard tube, with one end of the soft tube attached to the hard tube, and an inlet opening in the hard tube revealing a portion of the soft tube), can be used for check valves 30–38. It can also be seen that while nine checks valves located in nine separate air exit passages are illustrated, only one passage containing one check valve is necessary, although it is preferred in such an embodiment that the air exit passage and the check valve have sufficient cross-sectional area to allow air to quickly escape from vacuum chambers 4–7. Similarly, if one or more passages through side wall 68 are commonly connected prior to being joined to a check valve, the number of passages can exceed the number of check valves.

Figure 4:
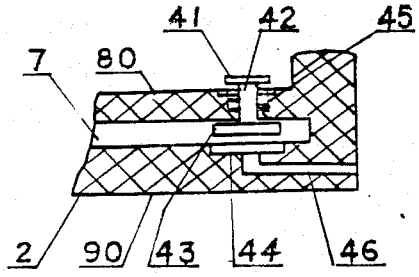
FIG. 4 shows a sectional view of one type of vacuum relief valve usable in this invention.

FIG. 1 also shows a vacuum relief valve 40, which is shown in detail in FIG. 4. Vacuum relief valve 40 comprises valve depression piston 41 connected via shaft 42 to vacuum relief valve seal 43. Relief valve seal 43 is biased away from vacuum relief valve seat 44 by spring 45. An opening in vacuum relief valve seat 44 is connected to the atmosphere via vacuum relief passage 46.

Valve depression piston 41 is located in sole 2 proximate the area upon which the heel of the user rests so that when the user is in a stationary standing position, piston 41 will be depressed by the heel, and relief valve seal 43 will be firmly positioned on relief valve seat 44, which closes off vacuum relief passage 46.

In use, as the user steps or walks on a surface, the resilient material of sole 2 is compressed, causing some of the air present in vacuum chambers 4–7 to flow through check valves 30–38 into the atmosphere until the pressure in vacuum chambers 4–7 equals atmospheric pressure. Thereafter, if the user's foot should shift somewhat, the resultant decompression of sole 2 will create a partial vacuum in vacuum chambers 4–7. This partial vacuum, transmitted to the surface upon which the user stands via vacuum cup passageways 13, 14, 17, 18, 21, 22, 25 and 26, and via vacuum cups 11, 12, 15, 16, 19, 20, 23 and 24, results in footwear 1 being firmly anchored to the surface, upon which the user steps or walks, due to atmosphere pressure. Moreover, since a heavier person will compress sole 2 more than a lighter person, the heavier person will force more air from vacuum chambers 4–7, thereby creating more suction.

One embodiment of this invention facilitates release of footwear 1 from the surface to which it is anchored by utilizing the normal motion of the user in stepping or walking. Specifically, when the user desires to move, his weight shifts from the heel of his foot to the ball of his foot. The removal of downward force from the user's heel allows biasing spring 45 to urge valve depression piston 41 upward, thereby causing vacuum relief valve seal 43 to rise and allowing air to enter the vacuum chambers through vacuum relief passage 46. The pressure in vacuum chambers 4–7 thus equalibrates to atmospheric pressure, the partial vacuum transmitted to the surface via vacuum cup passageways 13, 14, 17, 18, 21, 22, 25 and 26 and via vacuum cups 11, 12, 15, 16, 19, 20, 23 and 24 dissipates, and the user can continue with his step in a normal manner.

Figure 5:
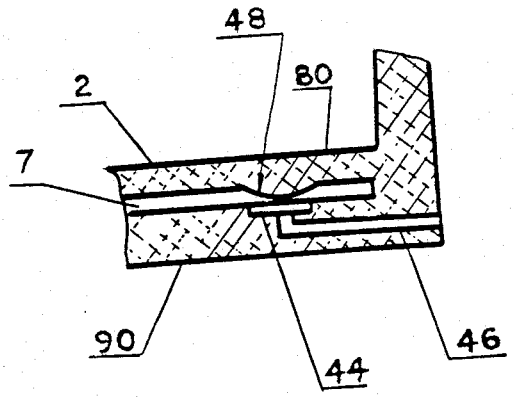
FIG. 5 shows a sectional view of another type of vacuum relief valve usable in this invention.

FIG. 5 shows another embodiment of vacuum relief valve 40. In FIG. 5, spherical surface 48 is formed in the roof of vacuum chamber 7. When the user puts weight on his heel, sole 2 compresses, causing spherical surface 48 to be firmly seated in vacuum relief valve seat, thereby preventing the flow of air through relief passage 46.

Another vacuum relief valve of the type shown in FIG. 5 can be used in lieu of check valves 30–38, if appropriately located in sole 2 approximately under the ball of the foot of the user, as toward the rear of vacuum chamber 4 in FIG. 1. This relief valve, denominated 900 (not shown in the Figures), would open and close a passage 910 (not shown) connecting vacuum chamber 4 with the atmosphere.

In the operation of such an embodiment, the user steps by first putting weight on his heel, thereby closing relief valve 40 located in vacuum chamber 7. The user continues the step by forwardly rotating his ankle, which progressively puts more of sole 2 in contact with the surface upon which he stands, thereby causing air contained in vacuum chambers 4–7 to exit through passage 910. As the step is finished, weight is placed on the ball of the user's foot, causing relief valve 900 to close passage 910. Thereafter, if the user's foot should shift somewhat, the resultant decompression of sole 2 will create a partial vacuum in vacuum chambers 4–7, as previously described.

While it is preferred for the air exit passageway or passageways and their check valves to have in aggregate a cross-sectional area that allows air to quickly escape from vacuum chambers 4–7, the present invention does function when the air exit passageway or passageways have a relatively small cross-sectional area. In such a case, the check valves can be dispensed with, and a partial vacuum will still temporarily be created to yield a suction force if the user's foot shifts somewhat.

Figure 6:
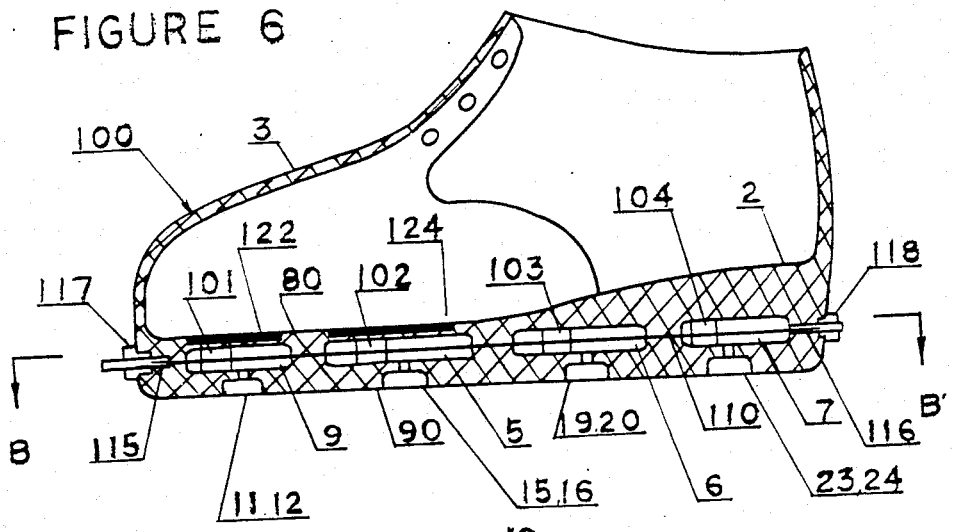
FIG. 6 shows a sectional view of another type of footwear embodying this invention.

FIG. 6 shows the present invention embodied in another type of footwear, a shoe 100. The upper 3 rises to just below the ankle to allow shoe 100 to be laced in the normal manner. In this embodiment, sealing blocks 101, 102, 103 and 104 can be horizontally moved in vacuum chambers 4–7 and positioned over vacuum passages 13, 14, 17, 18, 21, 22, 25 and 26 to prevent air from passing between the atmosphere and vacuum chambers 4–7. Specifically, sealing block 101 can be positioned over vacuum passageways 13 and 14; sealing block 102 can be positioned over vacuum passageways 17 and 18; sealing block 103 can be positioned over vacuum passages 21 and 22; and sealing block 104 can be positioned over vacuum passages 25 and 26. Closing off the vacuum passages with sealing blocks 101–104 prevents any partial vacuum developed in vacuum chambers 4–7 from being transmitted to vacuum cups 11, 12, 15, 16, 19, 20, 23 and 24. When so positioned, shoe 100 will function in a normal manner.

Shoe 100 or footwear 1 can also be made to perform in a normal manner by fully closing each screw 58 of valves 30–38. It can be seen in FIG. 3 that the amount of pressure required to be developed inside vacuum chambers 4–7 to urge ball 52 off seat 60 of each check valve 30–38 can be varied by rotation of pressure release level adjustment screw 58. Such rotation moves pressure plate 56 toward or away from ball 52, thereby varying the preload force in check spring 54, which force must be overcome before air pressure in vacuum chambers 4–7 can be released through check valves 30–38. When each pressure release level adjustment screw 58 of each check valve 30–38 is turned so that check spring 54 is fully compressed, check valves 30–38 are closed to the passage of air. When so closed, no vacuum will be developed in vacuum chambers 4–7. Use of sealing blocks 101–104 however allows adjustment screws 58 in each of check valves 31–38 to be dispensed with.

Figure 7:
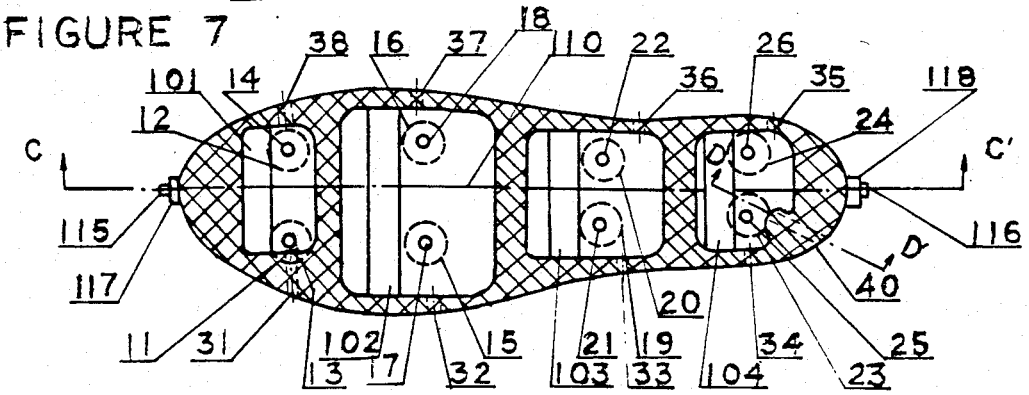
FIG. 7 is a sectional view taken along section line B–B′ in FIG. 6.
Figure 8:
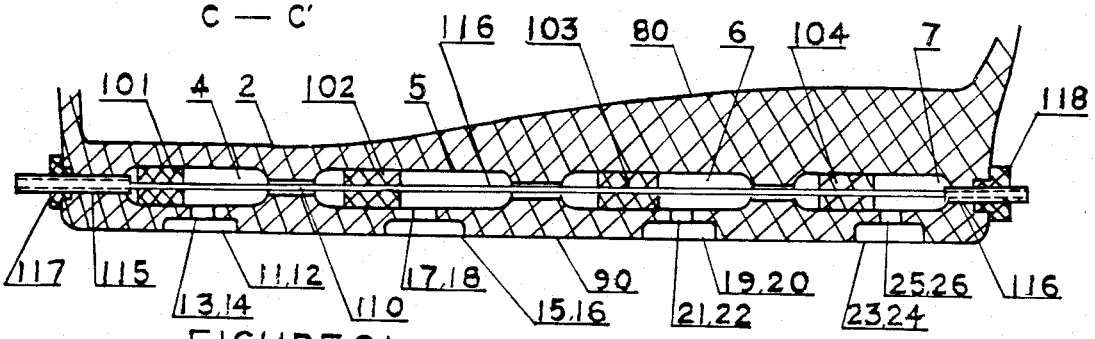
FIG. 8 is a section view of the sole of the footwear shown in FIG. 7, taken along section line C–C′.
Figure 9A:
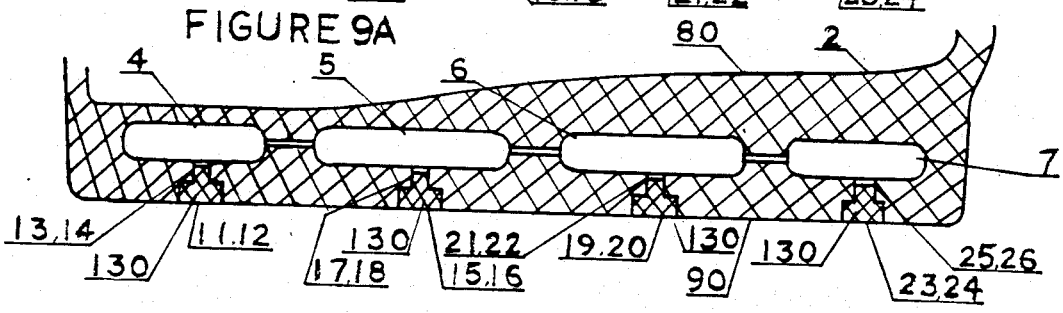
FIG. 9A is a sectional view of the sole of the footwear shown in FIG. 7, taken along section line C–C′, specifically to show the vacuum cup plugs of this invention.

Movement of resilient stoppers or sealing blocks 101–104, shown in FIGS. 6 and 7, is effected via slidable member 110, to which sealing blocks 101–104 are affixed. Slidable member 110 can be a steel or plastic cable or rod, or such other member as can readily be pushed and pulled. As can be seen in FIGS. 6–8, slidable member 110 is supported by forward bearing 115 and rear bearing 116. Forward bearing 115 is anchored in sole 2 by fastening button 117, and rear bearing 116 is anchored in sole 2 by fastening button 118. One end of slidable member 110 can be provided with suitable threads and a thumb screw (not shown), to allow the user to move slidable member 110 and sealing blocks 101–104 over vacuum passages 13, 14, 17, 18, 21, 22, 25 and 26. Other means to facilitate movement of slidable member 110 can also be used.

A reinforcing agent can be used on top face 80 or in the material between top face 80 and vacuum chambers 4–7 to minimize the possibility of that material unduly distending when a partial vacuum is created in vacuum chambers 4–7. This reinforcement agent can, for example, be a metallic or plastic plate, and can be continuous in length or composed of several segments to make bending of the footwear easier. FIG. 6 shows reinforcement plates 122 and 124 on top face 80. Reinforcement plate 122 is located over vacuum chamber 4 to prevent distending of material above that chamber. Reinforcement plate 124 performs the same function for vacuum chamber 5. No reinforcement plates are used over vacuum chambers 6 and 7 in FIG. 6, given the increased thickness of the sole overlying those chambers in this embodiment. A reinforcement agent as described can also be used in the embodiment of FIG. 1.

Figure 9B:
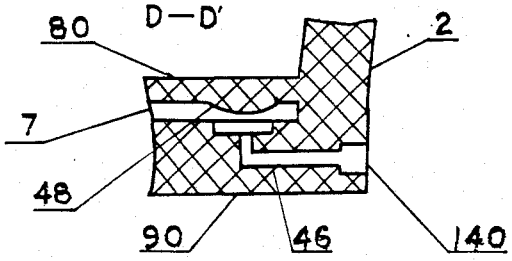
FIG. 9B is a sectional view, taken along section line D–D′ of FIG. 7, specifically to show the relief valve passage plug of this invention.

To prevent ingress of foreign material into vacuum chambers 4–7 when the vacuum feature of this invention is not being utilized, vacuum cup plugs 130 can be provided for insertion into vacuum cups 11, 12, 15, 16, 19, 20, 23 and 24. Vacuum cup plugs 130 can be made of a resilient material so that they can be press-fit into the vacuum cups. Alternatively, vacuum cup plugs 130 can be provided with screw threads for mating attachment to corresponding screw threads either in vacuum passages 13, 14, 17, 18, 21, 22, 25 and 26, or in vacuum cups 11, 12, 15, 16, 19, 20, 23 and 24, or in all. Likewise, vacuum relief passage 46, shown in FIG. 9B, can be modified to accept relief valve plug 140, which, as in the case for vacuum cup plugs 130, can either be press-fitted or screwed into place. Use of vacuum cup plugs 130 and relief valve plug 140, in addition to preventing ingress of foreign material into vacuum chambers 4–7, also prevent egress of air from those chambers, thereby yielding an air cushioned sole.

Figure 10A:
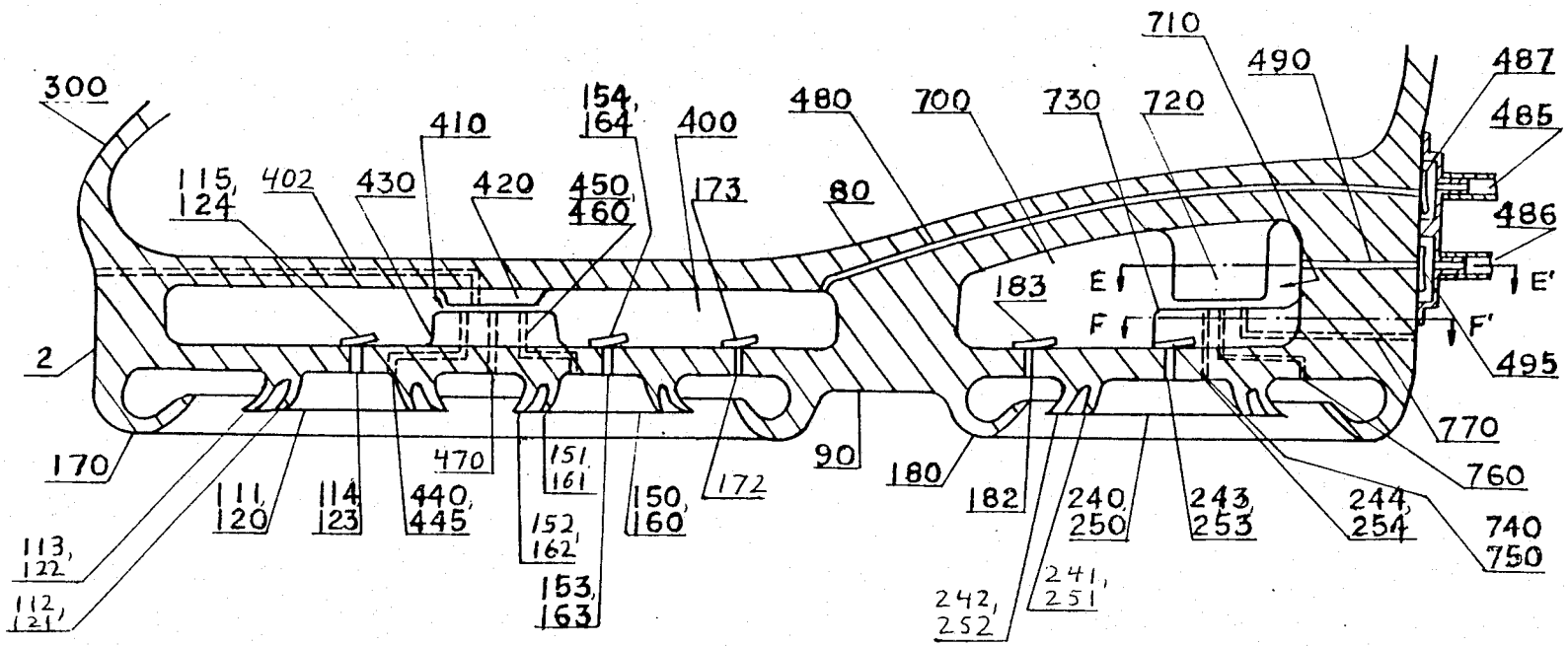
FIG. 10A is a sectional view of the sole of a further embodiment of this invention.
Figure 10B:
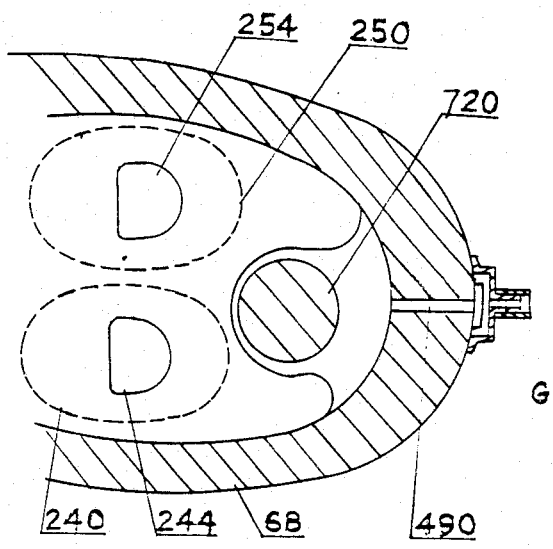
FIG. 10B is a section view taken along section line E–E′ of FIG. 10A and FIG. 10D.
Figure 10C:
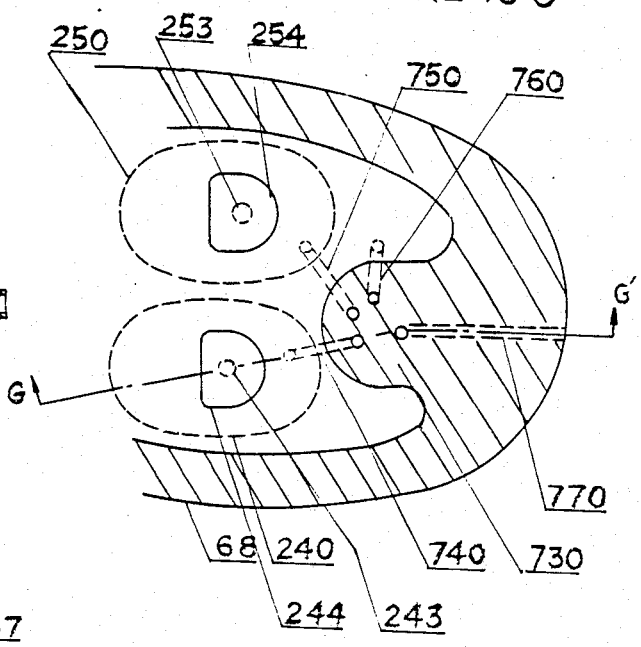
FIG. 10C is a sectional view taken along section line F–F′ of FIG. 10A and FIG. 10D.
Figure 10D:
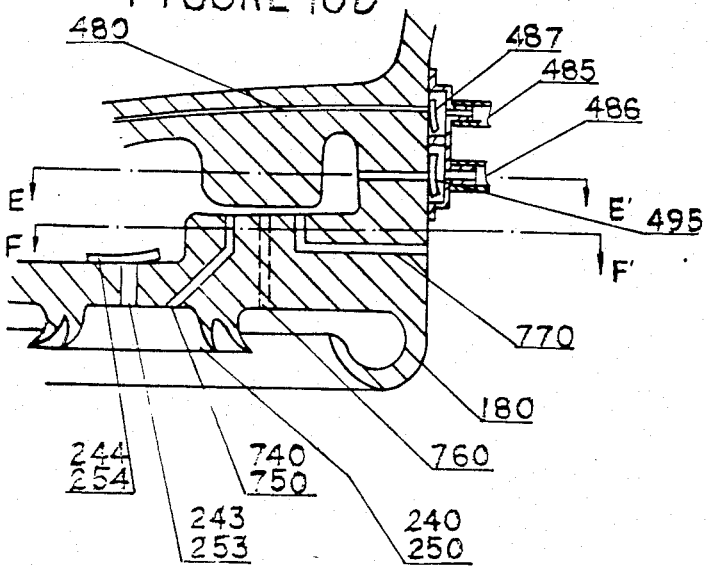
FIG. 10D is a sectional view taken along section line G–G′of FIG. 10C.

FIGS. 10A–12 show features that enhance the slip resistance of the footwear described above. FIG. 10A shows sole 2 having vacuum cups 111 and 120 respectively connected via vacuum cup passageways 114 and 123 to vacuum chamber 400, vacuum cups 150 and 160 respectively connected via vacuum cup passageways 153 and 163 to vacuum chamber 400, and vacuum cups 240 and 250 respectively connected via vacuum cup passageways 243 and 253 to vacuum chamber 700.

Each of vacuum cups 111, 120, 150, 160, 240 and 250 is respectively defined by inner vacuum cup skirts 112, 121, 151, 161, 241 and 251, each of which is contained in outer vacuum cup skirts 113, 122, 152, 162, 242 and 252 respectively. Employing more than one vacuum cup skirt lessens the chance that a stone, or a variation in the smoothness of the surface being walked upon, will prevent a vacuum from developing in the vacuum chambers.

Vacuum cups 111, 120, 150 and 160, along with their respective inner vacuum cup skirts and outer vacuum cup skirts, are contained inside the perimeter of toe skirt 170; likewise, vacuum cups 240 and 250, along with their respective vacuum cup inner skirts and vacuum cup outer skirts, are contained inside the perimeter of heel skirt 180. Both heel skirt 180 and toe skirt 170 have an inwardly curved lip, as shown in FIG. 10. When sole 2 is placed on a surface, the inwardly curved lips of heel skirt 180 and toe skirt 170 flatten, thereby increasing their contact area and minimizing the potential for air passing into the skirts, thereby reducing the suction force.

Figure 11:
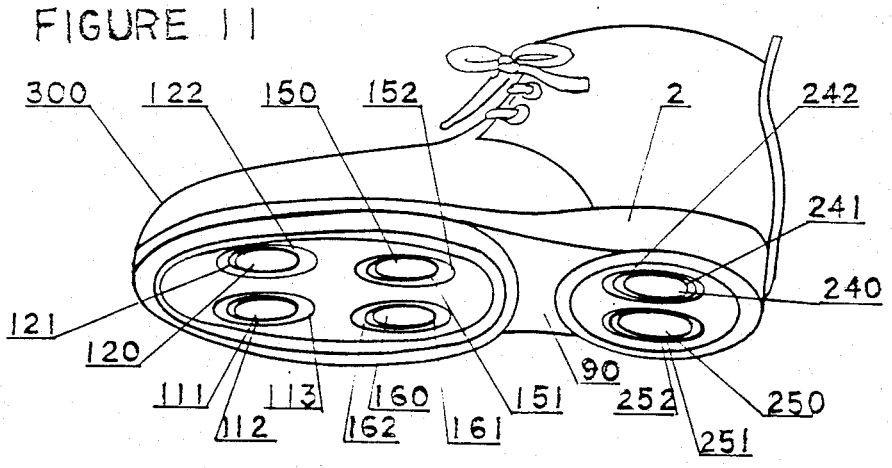
FIG. 11 is a perspective view of the bottom face of the sole of the embodiment of this invention shown in FIG. 10.

The heel and toe skirts shown in FIGS. 10A and 11 act to enhance slip resistance by increasing the amount of suction force produced in walking. Vacuum cups 111, 120, 150, 160, 240 and 250 perform substantially as described in connection with FIG. 1. However, as sole 2 is placed on the surface being stepped upon, heel skirt 180 and toe skirt 170 compress, which forces out some of the air within their peripheries. This increases the amount of suction force obtained when the user's foot subsequently moves, since suction force is developed not only by vacuum cups 111, 120, 150, 160, 240 and 250, but also by heel skirt 180 and toe skirt 170.

FIG. 10A further shows heel skirt passageway 182 connecting vacuum chamber 700 with an opening located in bottom face 90 of sole 2, which opening is located inside the perimeter of heel skirt 180 but outside the perimeter of any outer vacuum cup skirt. Correspondingly, toe skirt passageway 172 is shown connecting vacuum chamber 400 with an opening located in bottom face 90 of sole 2, which opening is located inside the perimeter of toe skirt 170 but outside the perimeter of any outer vacuum cup skirt. These skirt passageways allow air trapped under the skirts to continue to be exhausted to the vacuum chambers even after the vacuum cup skirts are in contact with the surface being walked upon. This increases the suction force that can be developed by the vacuum skirts.

The embodiment shown in FIG. 10A includes flap check valves 115 and 124 respectively positioned over vacuum cup passageways 114 and 123, flap check valves 154 and 164 respectively positioned over vacuum cup passageways 153 and 163, and flap check valves 244 and 254 respectively positioned over vacuum cup passageways 243 and 253. The embodiment of FIG. 10A also includes flap check valve 173 positioned over toe skirt passageway 172 and flap check valve 183 positioned over heel skirt passageway 182.

Employment of check valves 115, 124, 154, 164, 173, 183, 244 and 254 prevents air from reentering the heel skirt, toe skirt or vacuum cups from the vacuum chambers after the user has fully stepped down on top face 80 of sole 2. Thus, even if a vacuum cup, heel skirt or toe skirt fails to sealingly contact the surface being stood upon, that failure will not affect the suction force developed by the remaining cups and skirts. Although flap check valves are shown, other types of check valves, such as ball check valves, can be used.

As also shown in FIG. 10A, vacuum chamber 400 includes toe vacuum relief valve 410. Valve 410 comprises projection 420 in the roof of vacuum chamber 400 aligned over valve seat 430 on the floor of vacuum chamber 400. Relief passage 440 connects vacuum cup 111 to an opening located in seat 430. Relief passage 445 connects vacuum cup 120 to an opening located in seat 430. Similarly, relief passage 450 connects vacuum cup 150 to an opening located in seat 430, and relief passage 460 connects vacuum cup 160 to an opening located in seat 430. Additionally, relief passage 470 connects an opening located in seat 430 with an opening in bottom sole 90 located inside the perimeter of toe skirt 170, but outside the perimeter of any outer vacuum cup skirt. Intake passage 402 is shown in FIG. 10A as connecting an opening in the lower surface of projection 420 with an opening to the atmosphere; but passage 402 can just as well be connected to an opening in seat 420. Exhaust passage 480 connects vacuum chamber 400 to the atmosphere via outlet 485. Check valve 487 prevents air from flowing through outlet 485 into vacuum chamber 400.

A similar arrangement exists for vacuum chamber 700. As shown in FIGS. 10A–10D, heel vacuum relief valve 710 comprises projection 720 in the roof of vacuum chamber 700 aligned over valve seat 730. Relief passage 740 connects vacuum cup 240 with an opening located in seat 730 and relief passage 750 connects vacuum cup 250 with an opening located in seat 730. Additionally, relief passage 760 connects an opening located in seat 730 with an opening in bottom sole 90 located inside the perimeter of heel skirt 180 but outside the perimeter of any outer vacuum cup skirt. Intake passage 770 connects an opening located in seat 730 with an opening to the atmosphere. Exhaust passage 490 connects vacuum chamber 700 to the atmosphere via outlet 486. Check valve 495 prevents air from flowing through outlet 486 into vacuum chamber 700.

As the user steps on sole 2, projection 720 is pushed against seat 730, thereby closing off intake passage 770 and relief passages 740, 750 and 760. Similarly, projection 420 is pushed against seat 430, thereby closing off intake passage 402 and relief passages 440, 445, 450, 460 and 470. Air is nonetheless still able to escape from vacuum cups 111, 120, 150, 160, 240 and 250, heel skirt 180 and toe skirt 170 to vacuum chambers 400 and 700 via vacuum cup passageways 114, 123, 153, 163, 243 and 253, heel skirt passageway 182 and toe skirt passageway 172, and from vacuum chambers 400 and 700 to the atmosphere via exhaust passages 480 and 490 and outlets 485 and 486. Thereafter, slight movement of the user's foot creates a partial vacuum in vacuum chambers 400 and 700, causing footwear 300 to be firmly anchored to the surface.

When the user lifts his foot to move elsewhere, projection 720 separates from seat 730, thereby opening vacuum chamber 700 to the atmosphere via intake passage 770. Vacuum chamber 700 thus can attain atmospheric pressure, which atmospheric pressure is also transmitted to vacuum cups 240 and 250, and toe skirt 180, via relief passages 740, 750 and 760. In a similar manner, projection 420 separates from seat 430, allowing atmospheric air to enter vacuum chamber 400 via intake passage 402. Vacuum chamber 400 thus can attain atmospheric pressure, which pressure is transmitted to vacuum cups 111, 120, 150, 160, and toe skirt 170 via relief passages 440, 445, 450, 460 and 470. The user can then step in a normal manner.

Figure 12A:
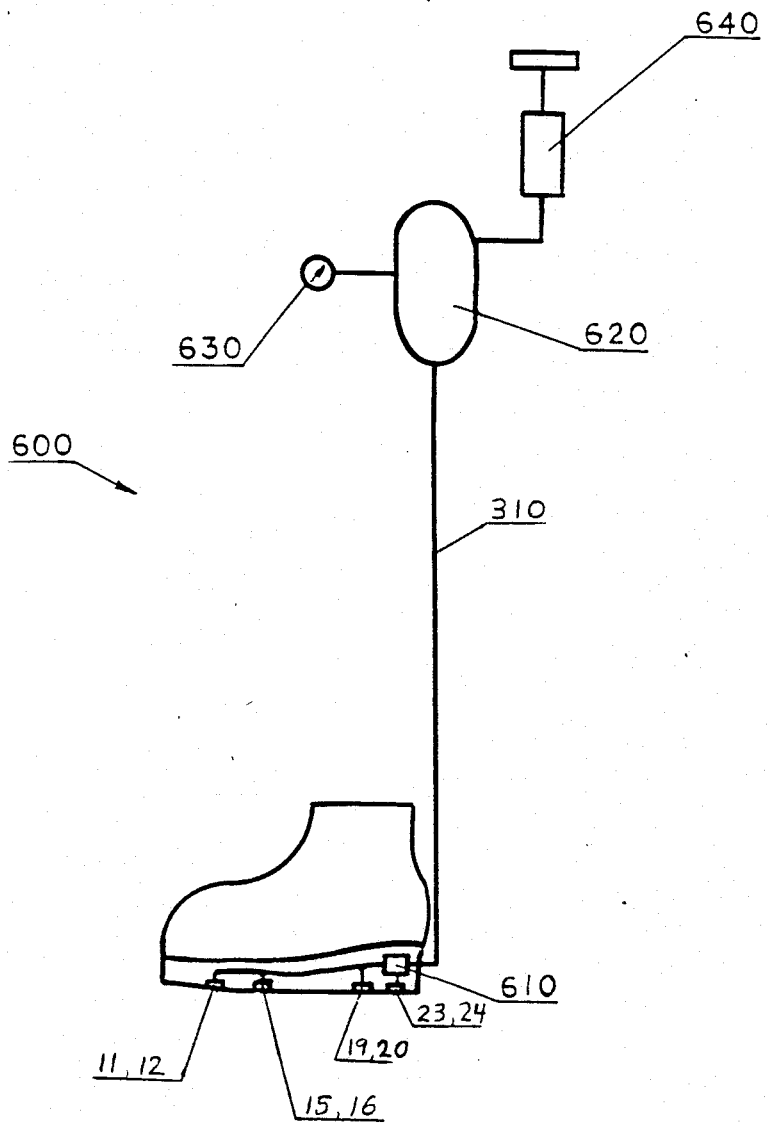
FIG. 12A is a schematic diagram showing a vacuum assist circuit for the footwear of the present invention.

The amount of suction force yielded by the present invention can also be increased by connecting the vacuum chambers to a vacuum source. FIG. 12A is a schematic of a vacuum assist circuit 600, comprising vacuum line 310, vacuum reservoir 620, vacuum gauge 630, and hand-operated vacuum pump 640. Vacuum line 310 connects vacuum chamber 610 with vacuum reservoir 620. Vacuum line 310 is additionally connected to each of outlets 485 and 486. Vacuum gauge 630 indicates the vacuum level within vacuum reservoir 620. Vacuum pump 640, connected to vacuum reservoir 620, is used to increase the vacuum level within reservoir 620. The user can monitor vacuum gauge 630 and operate vacuum pump 640 to maintain the required vacuum level within reservoir 620. Vacuum pump 640 can be mounted on the user at any convenient location, such as on the user's leg. For lightness, reservoir 620 can be omitted.

Figure 12B:
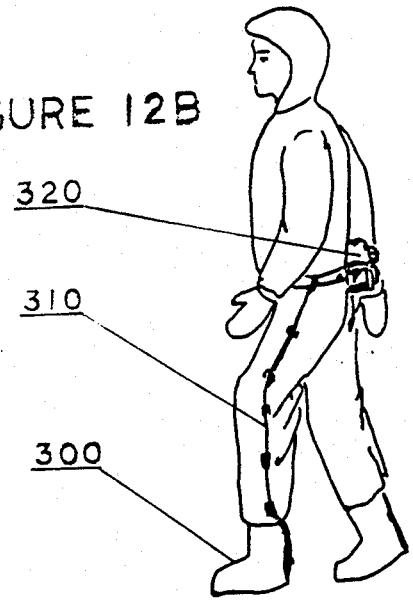
FIG. 12B shows a user of the present slip-resistant footwear with an external vacuum source connected to the footwear.

In FIG. 12B, there is shown a user wearing footwear 300 shown in relevant part in FIG. 10A The vacuum assist circuit is as shown in FIG. 12A, except that an integral vacuum source 320, which combines in one unit vacuum reservoir 620 with a motor driven vacuum pump, is used. Check valves 487 and 495, shown in FIG. 10, permits use of footwear without needing to operate vacuum source 320.

I claim:

1. Slip resistant footwear comprising:

(a) a sole having a top face and a bottom face, the bottom face for contact with a surface to be walked upon;

(b) at least one vacuum chamber whose volume decreases when force is applied to the top face of the sole and for each vacuum chamber;

(c) at least one respective first passageway between the bottom face of the sole and the vacuum chamber including a vacuum opening at the bottom face of the sole and a vacuum opening passageway connecting the vacuum opening with the vacuum chamber;

(d) means for permitting the passage of air from the vacuum chamber to the atmosphere, operative only when the volume of the vacuum chamber decreases and the pressure therein increases to above a predetermined level so that when the volume of the vacuum chamber increases the chamber acts as a vacuum reservoir to withdraw air from said first passageway and said vacuum opening; and (e) means for securing the sole proximate to a foot of the user.

2. The slip resistant footwear as in claim 1, further comprising means for permitting the passage of air from the atmosphere to the vacuum chamber, which means is rendered inoperative by pressure applied to the top face of the sole.

3. The slip resistant footwear as in claim 1, wherein the means for permitting the passage of air from the vacuum chamber to the atmosphere, operative only when the volume of the vacuum chamber decreases, is a check valve, located in an air exit passageway connecting the vacuum chamber to the atmosphere.

4. The slip resistant footwear as in claim 1, wherein the means for permitting the passage of air from the vacuum chamber to the atmosphere, operative only when volume of the vacuum chamber decreases, is a plurality of check valves, each located in an air exit passageway connecting the vacuum chamber to the atmosphere.

5. The slip resistant footwear as in claim 2, wherein the vacuum chamber is a chamber between the top face and bottom face of the sole and the sole is made of a resilient material.

6. The slip resistant footwear as in claim 1, further comprising a sole made of a resilient material and a plurality of vacuum chambers, each vacuum chamber defined by (a) a floor proximate the bottom face of the sole, (b) a roof proximate the top face of the sole, (c) the sidewall of the sole and (d) at least one transverse sole support.

7. The slip resistant footwear as in claim 6, wherein the vacuum chambers are commonly connected to allow the communication of air between the vacuum chambers, so that the air pressure in each will be approximately equal.

8. The slip resistant footwear as in claim 5, further comprising means for closing the first passageway.

9. The slip resistant footwear as in claim 8, wherein the means for closing the first passageway is a sealing block, located in the vacuum chamber, which can be positioned over the opening of the first passageway to the vacuum chamber.

10. The slip resistant footwear as in claim 9, wherein the sealing block can be slidably positioned over the opening of the first passageway to the vacuum chamber.

11. The slip resistant footwear as in claim 10, further comprising a slidable member affixed to the sealing block, which slidable member allows the user to move the sealing block inside the vacuum chamber.

12. The slip resistant footwear as in claim 1, wherein said vacuum opening is a vacuum cup.

13. The slip resistant footwear as in claim 1, further comprising a sealing plug removably positioned in the first passageway connecting the bottom face of the sole with the vacuum chamber, to prevent the passage of air from the atmosphere to the vacuum chamber through the passageway.

14. The slip resistant footwear as in claim 5, wherein the means for permitting the passage of air from the atmosphere to the vacuum chamber, which means is rendered inoperative by pressure applied to the top face of the sole, comprises:

(a) a second passageway connecting the vacuum chamber to the atmosphere; and (b) a vacuum relief valve that closes off the second passageway connecting the vacuum chamber to the atmosphere when pressure is applied to the top face of the sole.

15. The slip resistant footwear as in claim 3, wherein the check valve can be closed to the passage of air.

16. The slip resistant footwear as in claim 14, wherein the vacuum relief valve comprises:

(a) a projection formed in the roof of the vacuum chamber; and (b) a valve seat positioned under the spherical surface and connected to the second passageway connecting the vacuum chamber to the atmosphere.

17. The slip resistant footwear as in claim 1, further comprising a skirt having an inwardly curved lip on the bottom face of the sole, within the periphery of which is the opening to the first passageway.

18. The slip resistant footwear as in claim 1, further comprising a vacuum source connected to the vacuum chamber.

19. Slip resistant footwear comprising:

(a) a sole having a top face and a bottom face, the bottom face for contact with a surface to be walked upon;

(b) at least one vacuum chamber whose volume decreases when force is applied to the top face of the sole and for each vacuum chamber:

(c) at least one respective first passageway between the bottom face of the sole and the vacuum chamber including a vacuum opening at the bottom face of the sole and a vacuum opening passageway connecting the vacuum opening with the vacuum chamber;

(d) means for permitting the passage of air from the vacuum chamber to the atmosphere, operative when the pressure in the chamber increases to above a predetermined level so that when the volume of the vacuum chamber increases, the chamber acts as a vacuum reservoir to withdraw air from said first passageway and said vacuum opening which means is rendered inoperative by pressure applied by the ball of the foot of the user to the top face of the sole;

(e) means for permitting the passage of air from the atmosphere to the vacuum chamber, which means is rendered inoperative by pressure applied by the heel of the user to the top face of the sole; and (f) means for securing the sole proximate to a foot of the user.

20. Slip resistant footwear comprising:

(a) a sole having a top face and a bottom face; the bottom face for contact with a surface to be walked upon;

(b) at least one vacuum chamber whose volume decreases when force is applied to the top face of the sole and for each vacuum chamber:

(c) at least one respective first passageway between the bottom face of the sole and the vacuum chamber including a vacuum opening at the bottom face of the sole and a vacuum opening passageway connecting the vacuum opening with the vacuum chamber;

(d) a check valve preventing passage of air from the vacuum chamber through the first passageway;

(e) means for permitting the passage of air from the vacuum chamber to the atmosphere, operative only when the volume of the vacuum chamber decreases and the pressure therein increases to above a predetermined level so that when the volume of the vacuum chamber increases, the chamber acts as a vacuum reservoir to withdraw air from said first passageway and said vacuum opening;

(f) means for permitting the passage of air from the atmosphere to the first passageway, which means is rendered inoperative by pressure applied to the top face of the sole; and (g) means for securing the sole proximate to a foot of the user.

21. Slip resistant footwear comprising:

(a) a sole having a top face and a bottom face, the bottom face for contact with a surface to be walked upon;

(b) at least one vacuum chamber whose volume decreases when force is applied to the top face of the sole and for each vacuum chamber;

(c) at least one respective first passageway between the bottom face of the sole and the vacuum chamber including a vacuum opening at the bottom face of the sole and a vacuum opening passageway connecting the vacuum opening with the vacuum chamber;

(d) a second passageway connecting the vacuum chamber to the atmosphere, said second passageway having a small cross-sectional area;

(e) means for permitting the passage of air from the vacuum chamber to the atmosphere, operative only when the volume of the vacuum chamber decreases and the pressure therein increases to above a predetermined level so that when the volume of the vacuum chamber increases, the chamber acts as a vacuum reservoir to withdraw air from said first passageway and said vacuum opening; and (f) means for securing the sole proximate to a foot of the user.

22. The slip resistant footwear as in claim 20, wherein the first passageway comprises a first vacuum cup skirt to define a vacuum cup and a vacuum cup passageway connecting the vacuum cup and the vacuum chamber, and the footwear further comprises:

(a) a second vacuum cup skirt, the vacuum cup being within the perimeter of the second vacuum cup skirt;

(b) a third skirt on the bottom face of the sole, said third skirt having an inwardly curved lip, the second vacuum cup skirt being inside the perimeter of the third skirt; and (c) a skirt passageway connecting the vacuum chamber with the bottom face of the sole, whose opening on the bottom face is between the third skirt and the second vacuum cup skirt.

* * * * *